United States Patent [19]

Theiss

[11] Patent Number: 4,848,278

[45] Date of Patent: Jul. 18, 1989

[54] NUCLEAR STEAM GENERATOR SLUDGE LANCING METHOD AND APPARATUS

[75] Inventor: Scott M. Theiss, Palm Harbor, Fla.

[73] Assignee: Apex Technologies, Inc., Stuart, Fla.

[21] Appl. No.: 72,502

[22] Filed: Jul. 13, 1987

Related U.S. Application Data

[63] Continuation-in-part of Ser. No. 801,730, Nov. 26, 1985, Pat. No. 4,715,324.

[51] Int. Cl.[4] ..... F22B 37/48

[52] U.S. Cl. ..... 122/383; 122/392

[58] Field of Search ..... 376/310, 316, 312; 122/379, 381, 382, 392, 391, 390, 383; 134/172, 22.18; 15/316 R; 165/95

[56] References Cited

U.S. PATENT DOCUMENTS

| | | | |
|---|---|---|---|
| 4,037,569 | 7/1977 | Bennett et al. | 122/383 |
| 4,079,701 | 3/1978 | Hickman et al. | 122/382 |
| 4,424,769 | 1/1984 | Charamathieu et al. | 122/392 |
| 4,452,183 | 6/1984 | Yazidjian | 122/392 |
| 4,620,881 | 11/1986 | Booij | 122/382 |
| 4,653,435 | 3/1987 | Lebouc | 122/382 |
| 4,715,324 | 12/1987 | Muller et al. | 376/316 |

*Primary Examiner*—Deborah L. Kyle
*Assistant Examiner*—Daniel Wasil
*Attorney, Agent, or Firm*—Sybil Meloy

[57] ABSTRACT

Sludge-removing fluid lances are moved simultaneously toward the center of a tube bundle in a steam generator through diametrically opposite lance ports. Fluid-blocking suction dams are placed in the peripheral lane of the steam generator at diametrically opposite inspection ports from which fluid-entrained sludge is removed. All four of the ports are spaced apart by 90°. Fluid-entrained sludge is blocked on the opposite sides of both suction dams, thereby preventing redeposition of sludge in previously cleaned areas of the tube sheet of the generator. The fluid flow rates of the lances are controlled to be equal to each other, and the rate of removal of the fluid-entrained sludge through each suction dam is controlled to be the same as the fluid flow rate of each lance. A separate flushing stream in the peripheral lane is not required.

7 Claims, 4 Drawing Sheets

NUCLEAR STEAM GENERATOR SLUDGE LANCING METHOD AND APPARATUS

CROSS-REFERENCE TO RELATED APPLICATION

This application is a continuation-in-part of application Ser. No. 801,730, filed Nov. 26, 1985, now U.S. Pat. No. 4,715,324.

BACKGROUND OF THE INVENTION

1. Field of the Invention

This invention relates generally to the cleaning of steam generators and, more particularly, to an improved method and apparatus for removing sludge from the tube sheet of a nuclear steam generator.

2. Description of the Prior Art

Nuclear power plants typically utilize steam generators having a vertical inverted U-shaped tube bundle which carries the primary water directly heated by the nuclear reaction. Feedwater is carried by the shell side of the exchanger in contact with the tube bundle for generating steam to be directed to steam turbines.

Among the maintenance problems that can arise in such nuclear power plants, some of the most potentially troublesome include sludge build-up in the steam generator, and particularly relate to concentrations of sludge which may accumulate on the tube sheet at the lower end of the tube bundle.

This accumulation of sludge lowers steam production capacity, and the particles in the feedwater can cause abrasion of the U-tubes in the upper portions of the steam generator. These solids may even cause the steam turbine to foul if they are carried over in the steam. Also, since water chemistry cannot be controlled within the sludge piles, the steam generator tubes may corrode or dent.

Several problems are caused by damaged tubes. Primary water from the tube bundle may leak into the feedwater that is to be turned into steam, thus creating a safety hazard. Plugged and sleeved tubes reduce the heat transfer area of the steam generator. As more time is required to be allotted to maintenance, more radiation exposure is required for maintenance personnel. Also the steam generator's productive life span can be decreased significantly.

There are several U.S. patents disclosing various methods and apparatuses for the sludge lancing of steam generators:

U.S. Pat. Nos. 4,079,701 and 4,276,856 disclose a high pressure, low flow single movable lance system and method that require a fluid flushing stream continuously maintained from the pair of stationary flushing fluid injection nozzles inserted in one hand hole of the steam generator, around the annular space between the lower shell of the steam generator and the tube bundle, to a flushing fluid suction apparatus located diametrically opposite the first hand hole at a second hand hole. While the fluid flushing stream is continuously maintained, the single movable fluid lance is placed in the steam generator through the first hand hole and moved along the tube lane to dislodge sludge deposits from between the tube rows and move the sludge outward into the annular space where the sludge is entrained in the continuously flowing flushing fluid stream.

U.S. Pat. Nos. 4,445,465 and 4,498,427 disclose improved sludge lancing systems which alternately direct the entire fluid flow first to the single movable lance for dislodging the sludge from between the tube rows and moving it outward to the periphery of the tube bundle, and then to a stationary flushing fluid injector which directs the entirety of the available fluid around the periphery of the tube bundle to flush the sludge which was dislodged in the previous lancing cycle.

U.S. Pat. No. 4,424,769 discloses a sludge lancing system in which two streams of cleaning fluid under a high pressure are directed from the end portion of a lance toward the tubular plate between two parallel sheets of tubes and in directions which are fixed and symmetrical with respect to the direction of the two sheets of tubes. A mechanism is provided for cutting off the stream of high pressure water as the water jets confront the tubes during radial movement of the lance.

U.S. Pat. No. 4,452,183 discloses a sludge lancing system in which two high pressure water jets are operated simultaneously from opposite hand holes to insure that the sludge is moved to the periphery without redeposition of the sludge in areas of the steam generator. Furthermore, there is required simultaneous evacuation throughout the length of the zone in order to remove the sludge.

U.S. Pat. No. 4,527,515 discloses a control system for a single movable lance sludge removal system, wherein a valve is provided for directing a pressurized fluid to either a jetting outlet or a flushing outlet.

U.S. Pat. Nos. 4,273,076 and 4,492,186 disclose additional single movable lance sludge removal systems.

In addition, British Pat. No. 315,446 discloses a method and apparatus for removing sand from a casting, wherein two nozzles are mounted one above the other, with one nozzle emitting a very high pressure cutting stream, and the other nozzle emitting a lower pressure rinsing stream.

FIG. 1 illustrates a known sludge lancing process and apparatus and the problems associated therewith:

A. Access to tubesheet 10 was through 6"-handholes 12 and 14 (each end of blowdown lane 16).

B. High pressure lance 18 and suction system 19 were both inserted into the same 6"-handhole 12.

C. Two flexible, perforated suction headers, 20*a* and 20*b* were placed along the periphery 22 of the tube bundle 24.

D. Two high velocity jets 26 and 28 of water were established from the lance 18.

E. Sludge redeposition or wash back into the bundle occurred due to the high volume of water which exited the bundle and which overwhelmed suction header capacity.

F. During lancing of second side of generator via handhole 14, washback of sludge occurred in the first side lanced.

G. Flexible headers 20*a* and 20*b* required a large number of holes, thereby precluding sufficient suction near the outer ends of the headers.

FIG. 2 illustrates the essence of the U.S. Pat. No. 4,079,701 and the process and apparatus disclosed therein in an attempt to overcome the above problems:

A. An injection header 30 and a suction header 32 are respectively inserted diametrically opposite handholes 14 and 16 near the elevation of the tubesheet 10, thereby causing a circumferential fluid stream 34 to be established from the injection header 30 around the tube bundle to the suction header 32.

B. A fluid lance 36 is moved along the line between the injection and suction headers, while emitting a fluid jet 38 perpendicular to the movement of the fluid lance.

C. The fluid jet forces sludge to periphery where it is entrained in and carried away by the circumferential stream 34.

D. Thus, this patent discloses a sludge removal method that uses a fluid lance in conjunction with a peripheral fluid stream.

SUMMARY OF THE INVENTION

The general object of this invention is to provide a steam generator sludge lancing method and apparatus which is particularly efficient in removing sludge deposits from the tube sheet and tubes of a nuclear steam generator of the type having two lance ports and two inspection ports, wherein adjacent ports are spaced 90° apart.

A more specific object of this invention is to provide such a method and apparatus incorporating two simultaneously movable lanes which are inserted through lance ports spaced 180° apart, each lance incorporating a plurality of nozzles, and each contributing to the sludge-lancing operation and to the maintaining of the fine sludge particles in suspension, thereby facilitating the removal of fluid-entrained sludge to suction outlets located at inspection ports spaced 180° apart, and eliminating the need for a separate injection header for maintaining a continuously flowing flushing stream around the annulus or peripheral lane of the tube sheet of the generator.

Still another object of the invention is to provide fluid suction dams on the tube sheet near the suction outlets at the inspection ports for increasing the volume of sludge-laden water at the suction apparatus, thereby increasing the efficiency of the sludge removal operation.

A further object of the invention is to provide novel suction dams which contain bottom flow slots and which are installed across the entire width of the annulus at the two inspection ports, whereby the suction dams create a dam or flow blockage effect to prevent the flow of sludge-laden water in the annulus from carrying over from one side of the tube bundle to the other and also provide a means for supplying an equal and balanced suction flow across the entire width of the annulus at the suction locations, thereby preventing sludge redeposition.

The above and other objects are accomplished by providing a sludge lancing method and apparatus wherein two lances are simultaneously inserted through two lance ports located at 0° and 180° around the tube sheet, wherein specially designed suction dams are placed across the entire width of the annulus or peripheral lane at inspection ports located at 90° and 270°, wherein suction outlets are placed at the inspection ports, wherein the flow rate from each lance is matched exactly to that of the other lance, wherein the total flow rate on each side of the generators is matched exactly by the suction flow rate on each side and wherein each lance has a novel lance head and nozzle design.

DETAILED DESCRIPTION OF A PREFERRED EMBODIMENT

Figure 1:
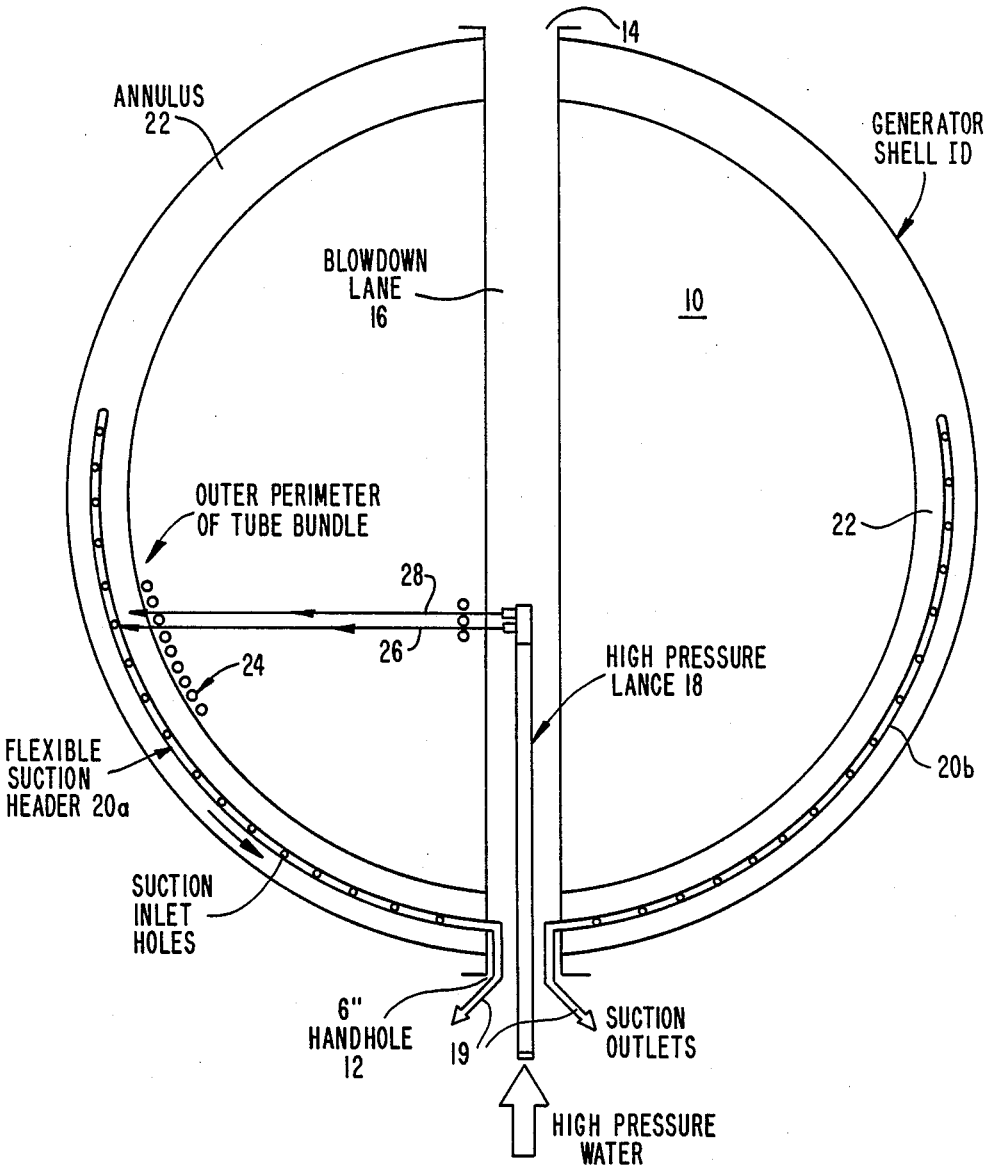
FIG. 1 PRIOR ART
FIG. 1 is a schematic top plan view of a steam generator and illustrates a known sludge lancing method and apparatus and the deficiencies thereof.
Figure 2:
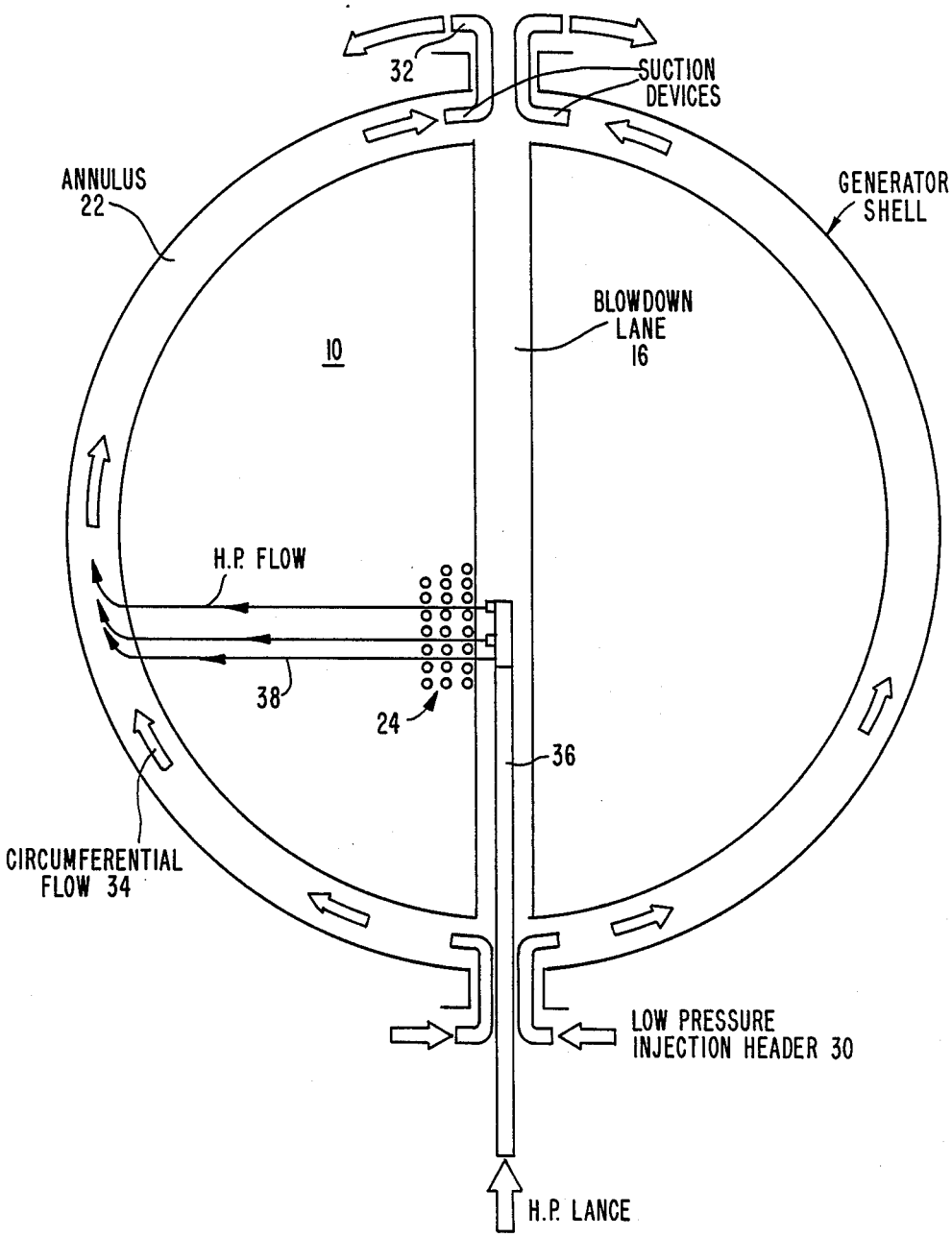
FIG. 2 PRIOR ART
FIG. 2 illustrates an attempt to overcome these deficiencies as disclosed in U.S. Pat. No. 4,079,701, for example.
Figure 3:
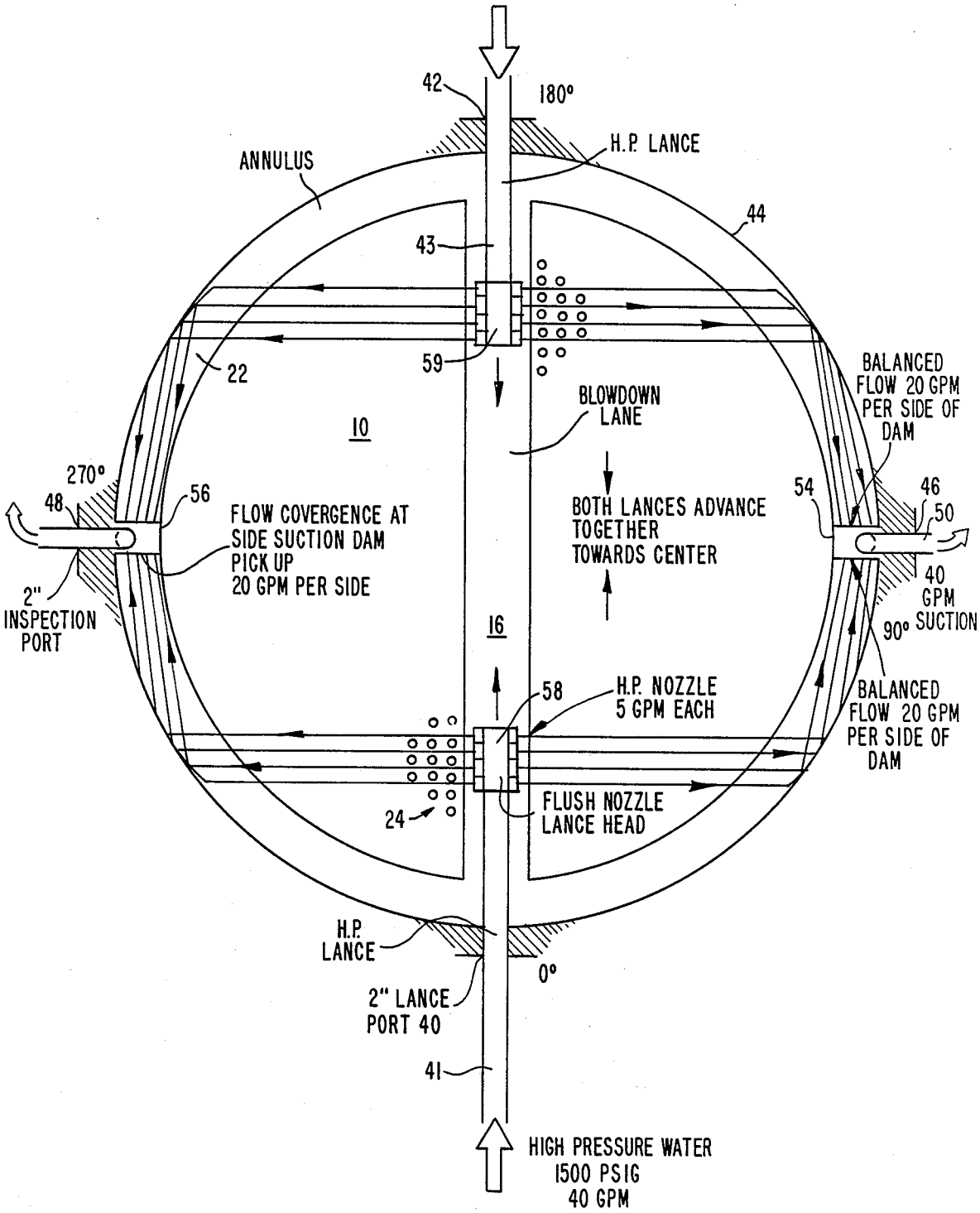
FIG. 3 is a schematic top plan view of a steam generator and illustrates the preferred method and apparatus of this invention.

As shown in FIG. 1, a pair of two-inch lance ports 40 and 42 are formed in the shell 44 at diametrically opposite points therein defined as 0° and 180°. Also, a pair of two-inch inspection ports 46 and 48 are formed diametrically opposite each other at 90° and 270°. Inserted in the inspection ports 46 and 48 are suction tubes 50 and 52, respectively, which are connected to a suitable suction pump such that each tube removes liquid from the annulus 22 at the rate of 40 GPM in the exemplary embodiment. Suction dams 54 and 56 are placed in the annulus 22 opposite inspection ports 46 and 48, respectively, and extend completely across the peripheral lane or annulus 22. Two high pressure (1,500 PSIG, 40 GPM) sludge lances 41 and 43 are inserted in the lance ports 40 and 42, respectively, and are simultaneously moved inwardly along the blowdown lane 16 while directing jets of water from high pressure nozzles in a direction perpendicular to the longitudinal axis of the blowdown lane. The lances 41 and 43 have at the inner ends thereof nozzle heads 58 and 59, each of which has four nozzles on opposite lateral sides of the head. In the preferred embodiment, each nozzle provides a water jet at the rate of 5 GPM, whereby each lance introduces water at the rate of 40 GPM.

Figure 4A:
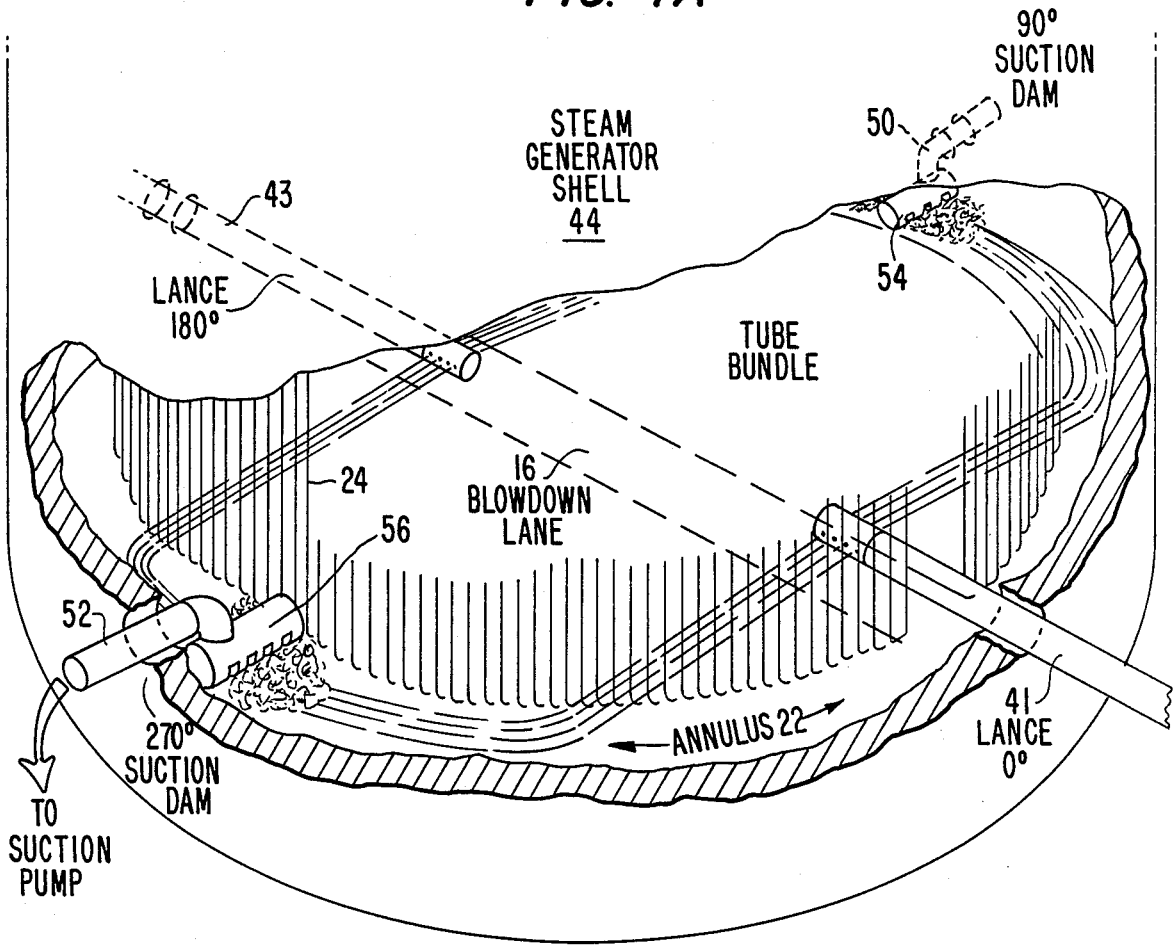
FIG. 4A is a front elevational view showing in detail the preferred embodiment of the invention, and in particular the construction and location of the suction dams.
Figure 4B:
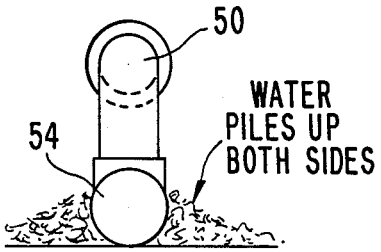
FIGS. 4B and 4C are partial views further showing the details of the suction dams.
Figure 4C:
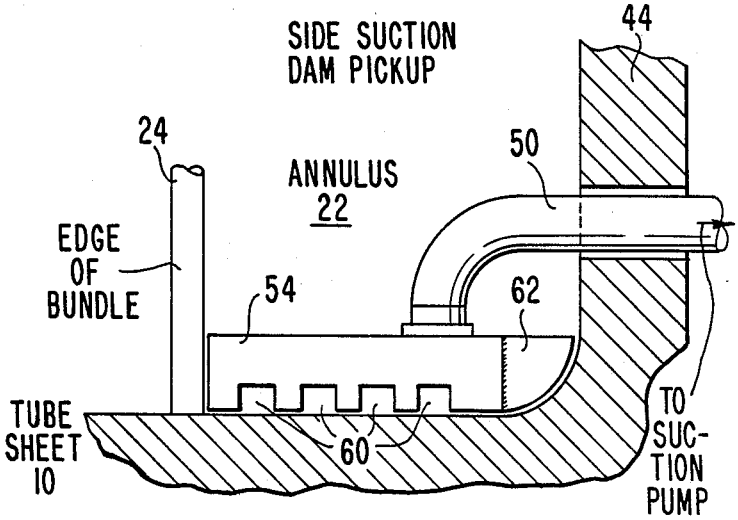

The location and construction of the suction dams 54 and 56 are more clearly illustrated in FIGS. 4A, 4B and 4C. Both dams are the same in construction, and FIGS. 4B and 4C illustrate only the suction dam 54. Each suction dam extends completely radially across the annulus between the edge of the tube bundle 24 and the inner wall of the shell 44, thereby providing a damming function in the sense that it tends to block the peripheral flow of water in the annulus 22. As clearly shown in FIGS. 4B and 4C with respect to suction dam 54, each dam takes the form of a hollow cylinder having a plurality of openings or slots 60 cut in the bottom surface thereof which is in contact with the top surface of the tube sheet. The suction tube 50 is in fluid communication with the interior of the suction dam via an opening in the top of the suction dam, to which opening the suction tube 50 is connected. The suction dam has an extension 62 whose outer surface is curved to match the curvature of the inner surface of the shell, thereby providing a more efficient damming function. The suction dams are preferably made of stainless steel.

In operation, the high pressure lances are operated simultaneously, working from the outside (lance ports) into the center of the tube bundle. The flow rate (40 GPM) from each lance is matched exactly to the other lance, and the total water flow rate on each side of the generator is matched exactly by the suction flow rate (40 GPM) on each side. This simultaneous lance operation and careful balancing and matching of the lance flows results in a convergence of the flow on each side at each suction dam, where the sludge-laden water is then removed through the suction dam via its associated suction tube. Flow rate control to ensure balanced convergence at each dam is critical in maximizing the prevention of sludge redeposition into previously cleaned areas. This control is achieved by careful design of the dimensions of the nozzles. The suction dams prevent the flow of sludge-laden water in the annulus from carrying over from one side of the tube bundle to the other (washback). The suction flow rate through each dam (40 GPM) is carefully controlled to match the high pressure injection rate (40 GPM) from each lance.

Consequently, there is no potential for washback into the previously cleaned side, because both sides are cleaned simultaneously. In addition, the combination of the suction dams across the annulus and the balanced flows converging at 90° and 270° prevents cross-migration of water in the annulus from one side of the generator to the other. The suction dam flow slot design (variable sized -$\frac{1}{4}$-$\frac{1}{2}$" rectangular slots) provides an equal suction flow rate across the entire width of the annulus, thereby preventing sludge fallout or pile-up at any point across the face of the suction dam.

In summary, then, the present invention incorporates the following differences from, and advantages over, previously known sludge-lancing methods and apparatus:

A. Simultaneous lancing of both side of generator.

B. Carefully balanced lance flows and suction removal rates.

C. High flow rate lance (40 GPM) with four jets in both directions.

D. Unique suction dams across annulus at 90° and 270°.

E. No peripheral injection header required.

What is claimed is:

1. A method of removing sludge from a steam generator of the type comprising an inner vertically oriented U-shaped bundle of heat transfer tubes having their open ends in fluid communication with holes in a tube sheet extending horizontally across the lower portion of a generally cylindrical outer shell of the generator, a central tube lane being defined between the legs of the U and extending between the diametrically opposite first and second lance ports in the outer shell, first and second diametrically opposite inspection ports in the outer shell, all four of said ports being spaced 90° apart, in a peripheral lane being defined between the tube bundle and the outer shell of the generator, said method comprising the steps of:

inserting in said first and second lance ports respective first and second fluid lances, each carrying on the inner end thereof a plurality of nozzles which emit a plurality of high pressure fluid jets when the lances are activated;

activating said lances and simultaneously moving them inwardly along said tube lane to dislodge sludge deposited on said tube sheet and around said tubes;

blocking the oppositely directed flows of fluid at both inspection ports with a radially elongated, hollow dam means disposed substantially across said peripheral lane relative to each of the inspection ports, said dam means having at least one aperture therein in communication with said peripheral lane to provide fluid communication with a source of suction; and removing, by suction, from said aperture through said fluid communication means, and through both of the inspection ports the fluid moving in opposite directions and containing fluid-entrained sludge.

2. The method as defined in claim 1 further comprising the step of controlling the fluid flow rates of both lances so that the fluid flow rates are equal.

3. The method as defined in claim 2 further comprising the step of controlling the rate of removing the fluid-entrained sludge at each inspection port to be equal to the fluid flow rate of each lance.

4. An apparatus for removing sludge from a steam generator of the type comprising an inner vertically oriented U-shaped bundle of heat transfer tubes having their open ends in fluid communication with holes in a tube sheet extending horizontally across the lower portion of a generally cylindrical outer shell of the generator, a central tube lane being defined between the legs of the U and extending between two diametrically opposite first and second diametrically opposite inspection ports in the outer shell, all four of said ports being spaced 90° apart, and a peripheral lane being defined between the tube bundle and the outer shell of the generator, said apparatus comprising;

first and second fluid sludge-lance means mounted on said outer shell in said first and second lance ports, respectively, each said lance means carrying on the inner end thereof a plurality of nozzles for emitting a plurality of high pressure fluid jets when said lance means are activated;

means for activating both of said lance means as they are simultaneously moved inwardly along said tube lane to dislodge sludge deposits on said tube sheet and around said tubes;

radially elongated hollow dam means disposed across said peripheral lane relative to each of said inspection ports for blocking oppositely flowing fluid in the peripheral lane, said dam means having at least one aperture in communication with said peripheral lane to provide fluid communication with a source of suction.

5. The apparatus defined in claim 4 wherein said dam means comprises suction dams disposed in the peripheral lane at said first and second inspection ports, respectively; each suction dam extending entirely across the radial dimension of said peripheral lane and comprising a hollow cylindrical member having a bottom in contact with the tube sheet in the peripheral lane, said bottom having openings for permitting the flow of the fluid-entrained sludge into said cylindrical member.

6. An apparatus as defined in claim 5 further comprising suction means, in fluid communication with each of said dam means, for removing fluid-entrained sludge from said peripheral lane.

7. An apparatus as defined in claim 6 further comprising means for controlling the fluid flow rate of both of said lance means to be equal to each other and to each of said suction means.

* * * * *

UNITED STATES PATENT AND TRADEMARK OFFICE

CERTIFICATE OF CORRECTION

PATENT NO. : 4,848,278

DATED : July 18, 1989

INVENTOR(S) : Scott M. Theiss

It is certified that error appears in the above-identified patent and that said Letters Patent is hereby corrected as shown below:

At column 4, line 4, before the word "detail" add the word -- more --.

Claim 4, at column 6, line 23, before the word "diametrically" add the phrase -- lance ports in the outer shell, first and second --.

Signed and Sealed this

Twenty-first Day of August, 1990

*Attest:*

HARRY F. MANBECK, JR.

*Attesting Officer*

*Commissioner of Patents and Trademarks*